United States Patent [19]

Komori

[11] Patent Number: 4,962,714

[45] Date of Patent: Oct. 16, 1990

[54] THREAD END DISPOSAL UNIT IN A THREAD CUTTING SEWING MACHINE

[75] Inventor: Norio Komori, Tochigi, Japan

[73] Assignee: SSMC Inc., Edison, N.J.

[21] Appl. No.: 355,932

[22] Filed: May 22, 1989

[30] Foreign Application Priority Data

Jun. 21, 1988 [JP] Japan ..... 63-81859[U]

[51] Int. Cl.[5] ..... D05B 65/04; D05B 65/06

[52] U.S. Cl. ..... 112/287; 112/253

[58] Field of Search ..... 112/253, 287, 291, 292, 112/293, 295, DIG. 1, DIG. 2, DIG. 3

[56] References Cited

U.S. PATENT DOCUMENTS 1,202,426 10/1916 Ray ..... 112/253 X
1,251,352 12/1917 De Voe ..... 112/295
2,846,967 8/1958 Doerr et al. ..... 112/291
3,690,276 9/1972 King et al. ..... 112/287
4,763,590 8/1988 Kojima et al. ..... 112/287

FOREIGN PATENT DOCUMENTS 2646326 5/1978 Fed. Rep. of Germany ..... 112/299

*Primary Examiner*—Werner H. Schroeder
*Assistant Examiner*—David K. Suto
*Attorney, Agent, or Firm*—Theodore Jay

[57] ABSTRACT

A thread end disposal unit in a thread cutting sewing machine has a thread end suction unit including a first suction tube having an open end positioned at the length of the starting end of a needle thread held by a thread end holder. A second suction tube is connected at a base end thereof to a base of the first suction tube via a suction device generating negative pressure for allowing the first suction tube to suck cut lengths of the needle thread. The device includes a Venturi-tube and an air compressor and a container storing the cut lengths as waste thread.

3 Claims, 3 Drawing Sheets

THREAD END DISPOSAL UNIT IN A THREAD CUTTING SEWING MACHINE

BACKGROUND OF THE INVENTION

1. Field of the Invention

The present invention relates to a thread end disposal unit in a thread cutting sewing machine having a thread end holder for holding a needle thread and a cutting device for cutting a starting end of the needle thread with progress of the sewing operation.

2. Description of Prior Art

A thread cutting sewing machine provided with an automatic thread cutting device for automatically cutting a thread end of a needle thread and a thread end of a bobbin thread employs an operation wherein after a sewing operation is completed the needle thread is hooked by a hook at the start of the next sewing operation. Consequently, the length of the starting end is drawn under the sewn material to produce an inferior seam, the so-called waste or the bird nest. If the starting end of the needle thread is pressed by a cloth presser at the start of the next sewing operation, no waste is produced, but this end of the thread remains on the sewn material so that in the finishing process the length of the starting end must severed from the remainder of the thread. To overcome this inconvenience, a sewing machine can be provided with the thread end holder for holding the starting end of the needle thread as disclosed, for example, in Japanese Utility Model Publication No. 58-5592.

This prior sewing machine is provided with a thread end holder for holding the needle thread which can prevent the length of the starting end of the needle thread left on the upper surface of the sewn material from being drawn into the lower side of the sewn material thus allowing the length of the starting end to be uniform. However, when this machine is used, the thread end still remains on the upper surface of the sewn material.

A sewing machine has been disclosed in which a cutting device is provided for cutting the length of the starting end of the needle thread to prevent the thread end of the needle thread at the start of the sewing operation from remaining as a long length on the sewn material. This is, for example, disclosed in Japanese Utility Model Laid-Open Publication No. 62-109079.

These prior art sewing machines which are provided with a thread end holder for holding the starting end of the thread needle thread and a cutting device for cutting the starting end of the needle thread are subject to certain disadvantages. In the first place the cut needle thread is dispersed as waste pieces of threads (hereafter referred to as thread waste) which are attached to the sewn material. This causes the quality of the sewn material to deteriorate. Secondly, the cut needle thread contaminates the sewing machine.

SUMMARY OF THE INVENTION

It is an object of the present invention to provide a thread end disposal unit in a thread cutting sewing machine adapted to cut starting ends of the needle thread which would otherwise be thread waste which employs a thread end unit to collect the cut ends and eliminate problems created by thread waste.

To achieve the above object, the thread end disposal unit in a thread cutting sewing machine according to the present invention includes a head. A needle bar is vertically movably supported by the head and has a needle at a tip end thereof. A needle thread is inserted into the hole of the needle. A presser bar is mounted on the head adjacent to the needle bar and is provided with a cloth presser. A thread end holder for holding a starting end of the needle thread includes a movable member having a hooked tip end; a stationary member made of an elastic material such as a spring and whgich is disposed opposite the movable member, and a bracket fixed to the head. the stationary member has a base fixed to the bracket. A cutting unit is provided at the underside near the back of the cloth presser for cutting the thread to sever the length of the starting end of the needle thread from the remainder of the thread during progress of the sewing operation. A thread end suction unit includes a first suction tube having an open end positioned at the starting end of the needle thread held by the thread end holder and a second suction tube. The second tube is connected at a base end thereof to a base of the first suction tube via a suction means generating negative pressure for allowing the first suction tube to suck the cut lengths of the needle thread. This means includes a Venturi-tube and an air compressor and is connected at a tip end thereof to a container for storing waste thread lengths so produced.

The above and other objects, features and advantages of the present invention will now be explained or will become apparent from the following description taken in conjunction with the accompanying drawings.

DESCRIPTION OF THE PREFERRED EMBODIMENT

Figure 1:
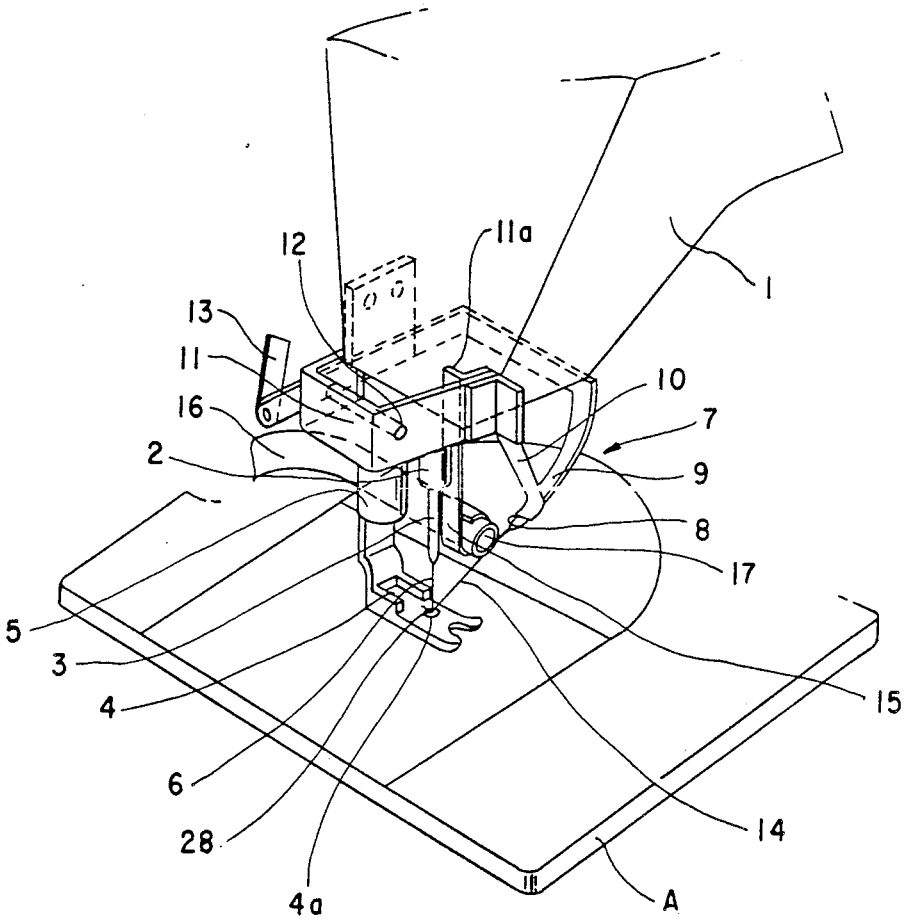
FIG. 1 is a perspective view showing a main portion of the thread end unit in a thread cutting sewing machine in accordance with a preferred embodiment of the present invention.
Figure 2:
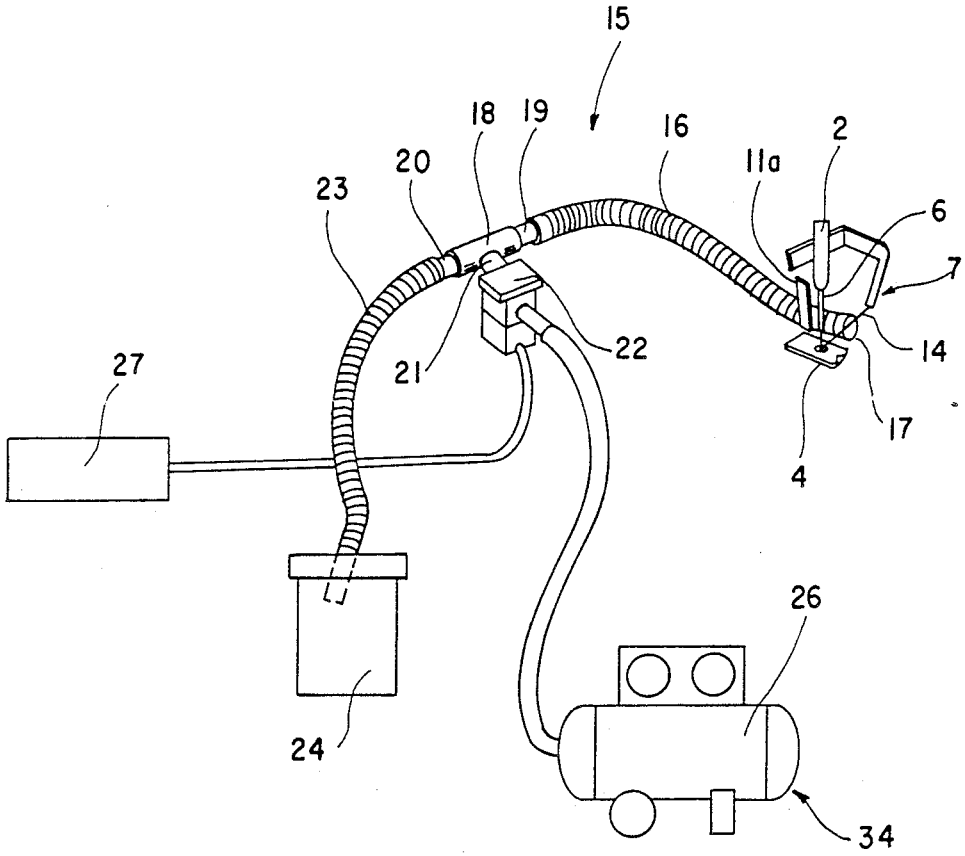
FIG. 2 is a perspective view showing in detail a thread end suction unit of FIG. 1.
Figure 3:
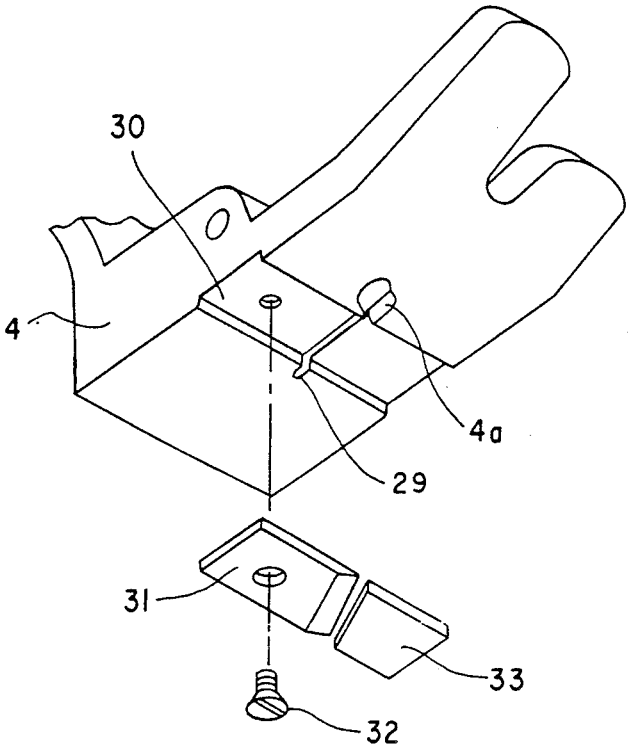
FIG. 3 is an exploded perspective view of a cloth presser of FIG. 1.

The embodiment shown in FIG. 1–4 includes: a thread cutting sewing machine has a head 1. A needle bar 2 is vertically movably supported by the head 1 and having at a tip end thereof a needle 3. A needle thread 6 is inserted into the hole of the needle 3. A presser bar 5 mounted on the head 1 adjacent to the needle bar 2 is provided with a cloth presser 4. A thread end holder 7 holds the tip of the length of the starting end of the needle thread 6. Holder 7 includes a movable member 9 having a hooked tip end 8; a stationary member 10 made of an elastic material such as a spring and is disposed opposite movable member 9; and a bracket 11 fixed to the head 1. The stationary member has a base fixed to the bracket 11. A cutting unit 28 is disposed at the back of the cloth presser 4 for cutting away the length of the starting end from the remainder of the needle thread 6. A thread end suction unit 15 includes a first suction tube 16, and a second suction tube 23 connected to the first suction tube 16 via suction means 34 composed of a Venturi-tube 18 and an air compressor 26.

The movable member 9 is curved substantially in a circular arc about a support shaft 12 and is supposed by the bracket 11 via the support shaft 12. A link 13 drivable by a drive unit disposed within the head 1 (not shown) is connected to the movable member 9 for pushing or pulling the movable member 9, namely, the movable member 9 is swingable by the link 13. The movable member 9 always elastically contacts the stationary member 10. The movable member 9 swings first toward the needle 3 about the support shaft 12 while the hooked tip end 8 hooks a tip end of the length of the starting end 14 of the needle thread 6, then swings backward, being returned to its original position for holding the tip end of the starting end 14 of the needle thread 6 between the movable member 9 and the fixed member 10.

The cutting unit 28 includes a fixed knife 31 which is secured to a knife fixing groove 30 defined in a back of the cloth presser 4 and has a cutter extending across a guide groove 29. The guide groove 29 is disposed in the cloth presser 4 so as to extend from a needle thread passage **4*a* at the side of the thread end holder 7 in the cloth feeding direction for guiding the starting end 14 of the needle thread 6. An embedded plate 33 is secured to the knife fixing groove 30 in opposing relation with the stationary knife 31. The guide groove 29** is interposed therebetween.

The thread end suction unit 15 is described in more detail below.

The first sunction tube 16 is flexible and has an open end 17. The portion adjacent to the open end 17 is supported by a support member **11*a* secured to the bracket 11 and positioned over a bed A of the thread cutting sewing machine. The open end 17 is positioned in the middle portion of the length of the starting end 14 of the needle thread 6 which is extended between the needle thread passage 4*a* of the cloth presser 4 and the thread end holder 7. The Venturi-tube tube 18 is attached to the lower surface of the bed A and has a suction port 19 provided with a known throttle configuration capable of producing a negative pressure upon receipt of compressed air from the compressor 26 via an air opening 21. Air is discharged via a discharge port 20. The suction port 19 is connected to a base end of the first suction tube 16 while the discharge port 20 is connected to a base end of the second tube 23 having another end connected to and opening into a container 24 for storing a thread waste. The operation of the air compressor 26 is controlled by open/close operation of a magnet valve 22 disposed at the air opening 21. A control unit 27 actuates and deactuates the magnet valve 22**.

The operation of the thread end disposal unit in a cutting sewing machine is described below.

In the cutting sewing machine, after the sewing operation is completed, firstly the needle thread and the bobbin thread are automatically cut, and secondly a tip end of the starting end of the needle thread 6 is held by the thread end holder 7 for preparation of the next sewing operation. From this state, a new sewing operation starts.

Figure 4:
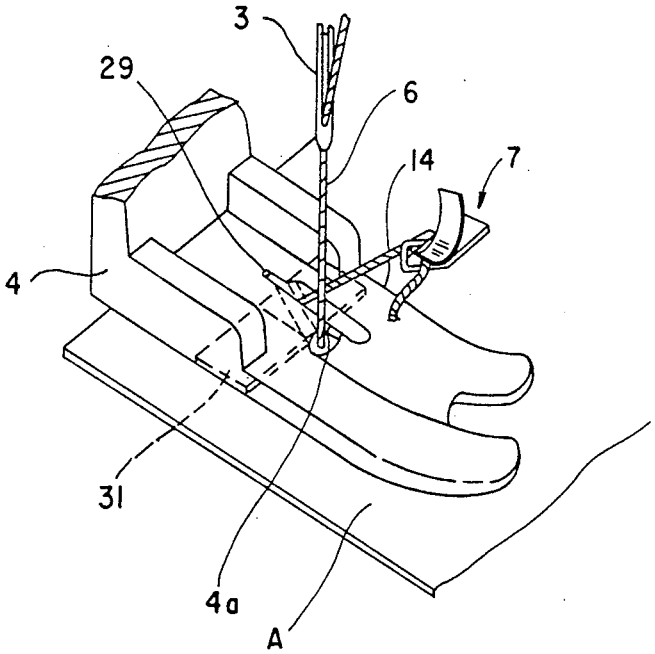
FIG. 4 is a perspective view illustrating the operation of the embodiment shown in FIG. 1.

Firstly, a first seam is formed by the needle 3, then successive seams are formed on the material to be sewn as the material is fed successively by a transfer means (not shown). Secondly, the rear end of the length of thread of the starting end 14 of the needle thread 6 is guided into the guide groove 29 from the needle thread passage **4*a* and contacts the blade of the fixed knife 31 so that the length of thread of the starting end 14 of the needle thread 6 is cut off. The cut starting end 14 of the needle thread 6 is retained and held by the thread end holder 7 during the sewing operation as illustrated in FIG. 4 where the cut starting end 14 is hung on the linear line connecting the thread end holder 7 and the guide groove 29 of the cloth presser holder 4**.

After the sewing operation is completed and the cutting sewing machine is stopped, the movable member 9 of the thread end holder 7 is swung about the support shaft 12 toward the needle 3 for holding the starting end 14 of a new needle thread 6. At this time, the cut length of thread 14 held by the thread end holder 7 is released from the pressed holding by the movable member 9 and the stationary member 10 and is slipped off. Secondly, the magnet valve 22 is actuated on the reception of a signal from the control unit 27 for introducing the compressed air inside the Venturi-tube 18 thereby producing the negative pressure at the throttle portion thereof. The cut length 14 is sucked from the open end 17 of the first suction port 16 by the thus generated negative pressure and discharged via the second suction tube 23 into the container 24 where it is stored as thread waste. Thirdly, after the cut length 14 is stored in the container 24, the magnet valve 22 is again actuated to stop the supply of the compressed air to the Venturi-tube 18. With repetition of a series of operations, the cut lengths 14 of the needle thread 6 as thread waste which are generated each time of the sewing operation of each sewn material are all stored in the container 24.

Although the suction means 34 as shown utilizes the Venturi-tube 18 and the air compressor 26 it may also take the form of a turbo-fan driven by a motor for producing a suction force.

The following advantages are obtained by the present invention.

Inasmuch as the cut lengths end of the needle thread as thread waste can be collected by the simply structured thread end suction unit, the disadvantages of deterioration of the sewn material caused by attachment of the thread waste to the sewn material are overcome; contaminatioin of the thread cutting sewing machine caused by the thread waste is eliminated; and, the working efficiency of the sewing operation is improved because the thread waste is removed automatically.

Although the invention has been described in its preferred form with particular reference to the detailed description and the drawings, it will be apparent to those skilled in the art that many variations and changes are possible in the invention without departing from the scope thereof.

What is claimed is:

1. A thread end disposal unit for use in a thread cutting sewing machine which performs a succession of sewing operations, said thread end disposal unit comprising:

a head;

a needle bar vertically movably supported by the head, said bar having a tip end;

a needle disposed in the tip end of the bar and having a thread receiving hole;

a needle thread inserted in the hole, the thread having a starting length with a tip end and a rear end;

a presser bar mounted on the head adjacent the needle bar and provided with a cloth presser;

a thread end holder for holding the tip end of the starting length of the thread, the holder including a movable member having a hooked tip end, a bracket secured to the head and a stationary spring member having a base secured to the bracket, the stationary member being disposed opposite the movable member;

cutting means disposed at an underside of the cloth presser near a back thereof for cutting said starting length from a remainder of the thread as the sewing operations progress; and a thread end suction device provided with a first suction tube having a front open end positioned at the starting length of the thread held by the holder and a rear end, second suction tube having a front discharge end and a rear end disposed adjacent the rear end of the first tube, suction means including a Venturi-tube and an air compressor for generating a negative pressure, the suction means interconnecting the rear ends of the first and second tubes to cause the front end of the first tube to suck a cut away length of thread and to cause this length to pass through the both tubes for discharge from the front end of the second tube, and a container for recieving a discharged cut away length from the front end of the second tube.

2. A thread disposal unit as set forth in claim 1 wherein the machine has a bed, and further including a support member secured to the bracket and supporting the first tube, which is flexible, over said bed, the cut away length of the thread having a middle portion which extends between the cloth presser and the thread end holder, the open end of the first tube being positioned at this middle portion.

3. A thread disposal unit as set forth in claim 2 wherein the Venturi-tube is attached to the bed and has a suction port having a throttle portion which produces the negative presure upon receipt of compressed air from the compressor.

* * * * *